US010580564B2

(12) United States Patent
Ju et al.

(10) Patent No.: US 10,580,564 B2
(45) Date of Patent: Mar. 3, 2020

(54) INDUCTOR HAVING ORGANIC FILLER

(71) Applicant: SAMSUNG ELECTRO-MECHANICS CO., LTD., Suwon-si, Gyeonggi-do (KR)

(72) Inventors: Jae Hee Ju, Suwon-si (KR); Je Ik Moon, Suwon-si (KR); Ye Eun Jung, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 280 days.

(21) Appl. No.: 15/496,563

(22) Filed: Apr. 25, 2017

(65) Prior Publication Data

US 2018/0090258 A1 Mar. 29, 2018

(30) Foreign Application Priority Data

Sep. 26, 2016 (KR) ..... 10-2016-0123402

(51) Int. Cl.

| | |
|---|---|
| ***H01F 27/255*** | (2006.01) |
| ***H01F 17/04*** | (2006.01) |
| ***H01F 27/29*** | (2006.01) |
| ***H01F 17/00*** | (2006.01) |
| ***H01F 27/28*** | (2006.01) |

(52) U.S. Cl.

CPC ..... *H01F 27/255* (2013.01); *H01F 17/0013* (2013.01); *H01F 17/04* (2013.01); *H01F 27/2804* (2013.01); *H01F 27/29* (2013.01); *H01F 27/292* (2013.01); *H01F 2017/048* (2013.01); *H01F 2027/2809* (2013.01)

(58) Field of Classification Search

None

See application file for complete search history.

(56) References Cited

U.S. PATENT DOCUMENTS 6,054,219 A * 4/2000 Satsu ..... H01F 1/24 427/220
6,198,373 B1 * 3/2001 Ogawa ..... H01F 17/0033 336/83
6,839,955 B2 * 1/2005 Uchikoba ..... H01F 27/027 228/248.1
6,855,222 B2 * 2/2005 Konoue ..... B32B 18/00 156/89.16

(Continued)

FOREIGN PATENT DOCUMENTS

EP 0619584 A2 * 10/1994 ..... H01F 1/26
JP 2007227426 A * 9/2007

(Continued)

OTHER PUBLICATIONS

Derwent Abstract Translation of JP 2007-227426 A. (Year: 2007).*

*Primary Examiner* — Kevin M Bernatz
(74) *Attorney, Agent, or Firm* — Morgan, Lewis & Bockius LLP

(57) ABSTRACT

An inductor includes a body having a coil, a magnetic material surrounding the coil, and a resin; and an external electrode disposed on at least a surface of the body. The body disposed in the inductor includes a particle which may soften an external impact acting on the inductor, in addition to acting on the magnetic material and the resin, and the external impact may be a physical impact or a thermal impact.

21 Claims, 4 Drawing Sheets

(56) References Cited

U.S. PATENT DOCUMENTS 7,251,120 B2 * 7/2007 Takazawa ..... H01F 17/0013 361/311
8,277,678 B2 * 10/2012 Cheng ..... H01F 1/344 252/62.54
8,427,265 B2 * 4/2013 Hachiya ..... H01F 17/0013 336/83
9,711,273 B2 * 7/2017 Suzuki ..... H01F 27/29
2002/0190830 A1 * 12/2002 Matsumoto ..... H01F 3/10 336/83
2003/0214793 A1 * 11/2003 Uchida ..... H03H 7/0115 361/761
2005/0200438 A1 * 9/2005 Renaud ..... B82Y 25/00 335/84
2005/0208383 A1 9/2005 Totsuka et al.
2009/0243780 A1 * 10/2009 Inoue ..... H01F 1/15366 336/200
2013/0025931 A1 1/2013 Oyama et al.
2013/0293334 A1 * 11/2013 Shin ..... H01F 1/26 336/192
2014/0002221 A1 * 1/2014 Shin ..... H01F 17/04 336/83
2015/0099115 A1 * 4/2015 Maeda ..... H01F 1/24 428/370
2015/0170820 A1 * 6/2015 Kadir ..... H01F 27/292 336/178
2015/0248963 A1 * 9/2015 Inaba ..... H01F 1/26 363/131
2015/0270053 A1 * 9/2015 Cha ..... C25D 7/001 336/192
2018/0151279 A1 * 5/2018 Ueyama ..... H01F 1/26
2018/0268988 A1 * 9/2018 Lee ..... H01F 27/2804
2018/0366246 A1 * 12/2018 Park ..... H01F 17/0013

FOREIGN PATENT DOCUMENTS

JP 2008-166455 A 7/2008
JP 5435040 B2 3/2014
KR 10-0699215 B1 3/2007
KR 10-2010-0026742 A 3/2010
WO WO-0175915 A2 * 10/2001 ..... H01F 3/14

* cited by examiner

INDUCTOR HAVING ORGANIC FILLER

CROSS-REFERENCE TO RELATED APPLICATION

This application claims the benefit of priority to Korean Patent Application No. 10-2016-0123402, filed on Sep. 26, 2016 with the Korean Intellectual Property Office, the entirety of which is incorporated herein by reference.

TECHNICAL FIELD

The present disclosure relates to an inductor, and more particularly, to a power inductor suitable for implementation of a high-capacity, compact product for significantly reducing a module area within a set of electronic products and implementation of a high-value system in package (SiP)-type modules.

BACKGROUND

As electronic products have become more complex and have multiple functions, compact, high-current, and high-capacity electronic components have been demanded. When a coil is reduced in size to make a power inductor compact, the volume of a body region, in which an internal core portion of the coil is formed, may also be decreased. When the volume of the internal core portion is reduced, the inductor may be vulnerable to external stress or thermal impact.

In addition, a power inductor employed in a system in package (SiP) essentially secures reliability in an internal environment thereof, and the reliability of the power inductor may be influenced by external factors, as well as by the characteristics of a material included in the power inductor itself.

SUMMARY

An aspect of the present disclosure may provide an inductor which may effectively disperse stress that may occur by thermal impact acting on the inductor, and which, in particular, may prevent cracking caused by impact externally applied thereto.

According to an aspect of the present disclosure, an inductor may include a body including a magnetic powder particle having magnetic characteristics, and a base resin. The body may include an organic filler dispersed in the base resin.

According to another aspect of the present disclosure, an inductor may include a body including a coil, and an external electrode disposed on an outer surface of the body. The body may include a magnetic powder particle, a base resin, and a buffer powder particle.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
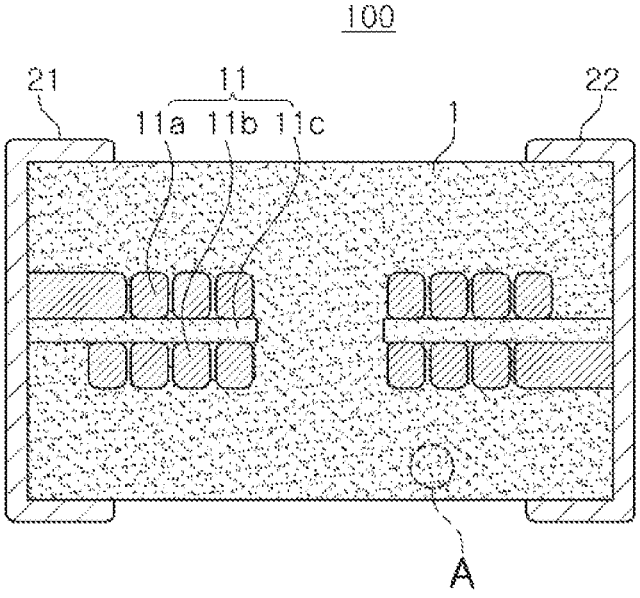
FIG. 1 is a schematic cross-sectional view of an inductor, according to an embodiment.

Hereinafter, embodiments of the present disclosure will be described with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that although the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s), as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations, depending on a particular directional orientation of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape resulting from manufacturing. The following embodiments may also be constituted alone or as a combination thereof.

The contents of the present disclosure described below may have a variety of configurations and only a required configuration is proposed herein, but the present disclosure is not limited thereto.

Hereinafter, an inductor, according to an embodiment, will be described, but the present disclosure is not limited thereto.

Inductor

Figure 2:
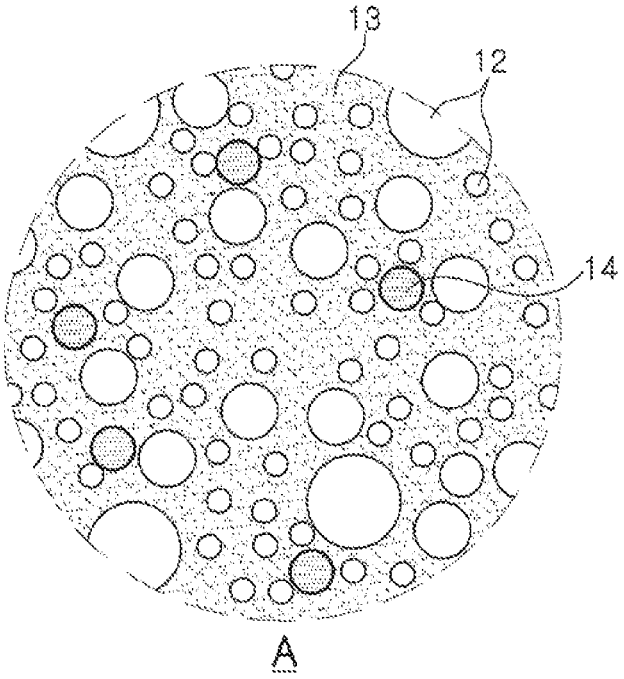
FIG. 2 is an enlarged view of region A, illustrated in FIG. 1.

FIG. 1 is a schematic cross-sectional view of an inductor, according to an embodiment. FIG. 2 is an enlarged view of region A illustrated in FIG. 1.

Referring to FIG. 1, an inductor 100 may include a body 1, in which a coil 11 may be embedded, and a first external electrode 21 and a second external electrode 22 disposed on at least one of outer surfaces of the body 1.

The coil 11 may be a winding type coil formed using a winding method, a thin film type coil formed using a thin film method, or a stack type coil formed using a stacking method. Hereinafter, as an example, a thin film type coil formed using a thin film method, illustrated in FIG. 1, will be described. The coil 11 may include a support member 11*c*, and a first coil 11*a* and a second coil 11*b* disposed on a surface and an opposing surface thereof, respectively. The first and second coils 11*a* and 11*b* may be formed as plating layers on the support member 11*c*, using a plating process, which may be advantageous from the viewpoint of thinning of the inductor 100. A via, electrically connecting the first coil 11*a* to the second coil 11*b*, may be formed by punching or drilling a region in which the via is to be formed, in a thickness direction of the support member 11*c*, so as to form a via hole, and by filling an interior of the formed via hole with a conductive material. The via may be formed of a plating layer, plated with a conductive material using a plating process, or may be formed of a conductive layer that is fired after a conductive paste is filled.

The first and second coils 11*a* and 11*b* may include a material having excellent electrical conductivity, and may be formed of, for example, at least one of gold (Au), silver (Ag), platinum (Pt), copper (Cu), nickel (Ni), palladium (Pd), aluminum (Al), and titanium (Ti), or alloys thereof, but may be employable without limitations, as long as it may include a common conductive material.

Referring to FIG. 2, the body 1 may include a magnetic powder particle 12 having magnetic characteristics, a base resin 13, and an organic filler 14, in order to embed a coil.

The magnetic powder particle 12 may be formed of a magnetic material having magnetic characteristics, for example, at least one of Fe, an Fe—Ni-based alloy, an Fe—Si-based alloy, an Fe—Si—Al-based alloy, an Fe—Cr—Si-based alloy, an Fe-based amorphous alloy, an Fe-based nanocrystal alloy, a Co-based amorphous alloy, an Fe—Co-based alloy, an Fe—N-based alloy, an MnZn-based ferrite, and an NiZn-based ferrite.

The base resin 13 may be formed using an epoxy resin which is a thermosetting resin, and may also be formed using a polyimide resin as an example of a thermosetting resin.

The organic filler 14 may include a polymer material, and, in particular, may include preferably a thermoplastic resin. For example, the organic filler 14 may include acrylonitrile-butadiene-styrene resin (ABS), cellulose acetate, nylon, polymethyl methacrylate (PMMA), polybenzimidazole, polycarbonate, polyether sulfone, polyetherether ketone (PEEK), polyetherimide (PEI), polyethylene, polylactic acid, polyoxymethylene, polyphenylene oxide, polyphenylene sulfide, polypropylene, polystyrene, polyvinyl chloride, ethylene vinyl acetate, polyvinyl alcohol, or polyethylene oxide.

In particular, the organic filler 14 may be PMMA beads.

The PMMA beads may be formed to have a shape close to a substantially spherical shape. Here, the PMMA beads may allow a surface area of the organic filler 14 to be significantly increased, thus being advantageous in the dispersion and removal of stress externally applied to the organic filler 14.

Because the PMMA beads have excellent dispersibility in an epoxy resin and magnetic powder particle, including Fe, and have a relatively small change (low modulus) in physical properties thereof at the time of a temperature rise, the PMMA beads may be suitable for absorbing stress that may occur due to a mismatch between coefficients of thermal expansion (CTE) when a thermal impact acts on the PMMA beads.

The organic filler 14 may have an independent grain boundary, distinct from the magnetic powder particle. In other words, the organic filler 14 is distinct from a particle having magnetic characteristics of a common magnetic powder-organic compound, or a particle having a multilayer structure of magnetic powder particle, inorganic insulating and polymer insulating layers, formed of a polymer insulating material.

The organic filler 14 may have a composition different from that of another organic filler, dispersed adjacent to the organic filler 14. For example, PMMA beads may be applied to a portion of an organic filler included in a body, and an elliptically formed polypropylene resin may also be applied to the remainder of the organic filler, which may be selected in consideration of material design of a user and required physical properties.

The body 1 may include, based on 100 wt % of the magnetic powder particle 12, the base resin 13 of 1 wt % or greater and 50 wt % or less, and the organic filler 14 of 0.01 wt % or greater and 50 wt % or less. The contents of the magnetic powder particle 12, the base resin 13, and the organic filler 14 may be changed, according to required physical properties or environments of the inductor 100. When the content of the base resin 13 is less than 1 wt %, dispersibilities of the magnetic powder particle 12 and the organic filler 14 may not be secured, and when the content of the base resin 13 is greater than 50 wt %, magnetic permeability of the inductor 100 may not be provided. In a similar manner, when the content of the organic filler 14 is less than 0.01 wt %, a buffer function may not be sufficiently exhibited. When the content of the organic filler 14 is greater than 50 wt %, a polymer material may be included in an excessive amount, it may be difficult to secure the magnetic permeability.

Figure 3:
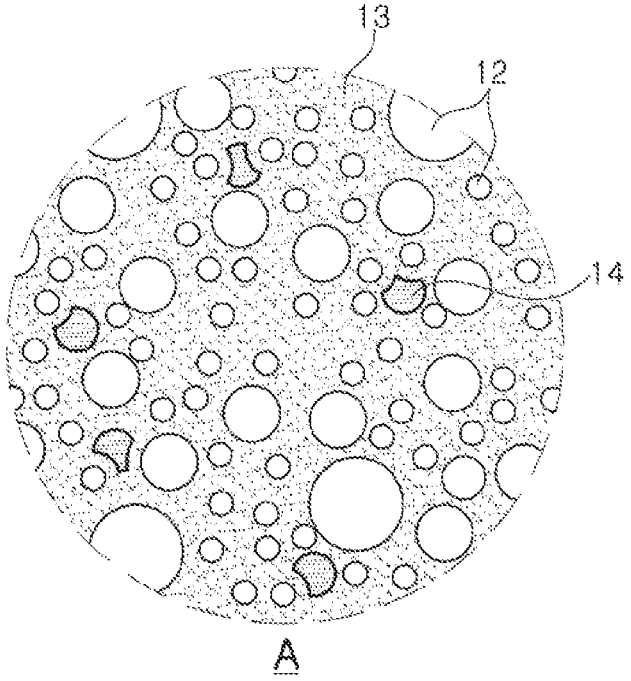
FIG. 3 is a schematic view of a deformed shape of an organic filler, after thermal impact is undertaken, to region A, illustrated in FIG. 2.

FIG. 3 is a schematic view of a deformed shape of an organic filler after a thermal impact acts on the region A illustrated in FIG. 2.

Referring to FIG. 3, the organic filler 14 may function as a buffer which may reduce and remove stress between the magnetic powder particle 12 and the base resin 13.

Because the organic filler 14 is not fully deformed due to a thermal impact, and has low modulus suitable for dispersing and reducing stress, applied to an interior of the organic filler 14, the organic filler 14 may maintain the strength of the entirety of the body 1 even in a temperature rise environment.

When the inductor 100 is mounted in a package, internal stress of the body 1 of the inductor 100 may be increased, due to a mismatch between coefficients of thermal expansion of the various materials included in the package, at the time of an occurrence of a thermal impact. In the case that such internal stress is not properly dispersed or removed, cracking of the inductor 100 may occur. The inductor 100, according to an embodiment, may solve the above concerns by including an additional organic filler in the body 1.

A mechanism, in which the organic filler 14 included in the body 1 functions as a stress buffer, will be briefly described. When a temperature of the body 1 of the inductor 100 is increased due to an external thermal impact, the organic filler 14 having stable modulus at a high temperature may effectively absorb the shock of a mismatch or repulsion due to the temperature rise of the body 1. This means that, when a temperature of the body 1 is increased, if the body 1 includes an organic filler, a degree of a change in movements or physical properties of the materials included in the body 1 may be lesser, compared to the case in which the body 1 does not include an organic filler, and also means that, as the organic filler is added in a predetermined amount, sensitivity according to a change in temperature, and, in particular, to a temperature rise, may be reduced.

Even in the case that the organic filler 14 does not include a thermoplastic resin, the organic filler 14 may be used as a material that reduces a thermal impact, as long as the organic filler 14 is a buffer powder particle, indicating certain physical properties.

An inductor, according to another embodiment, may include a buffer powder particle that exhibits a function corresponding to that of an organic filler included in a body, instead of the organic filler.

Figure 4:
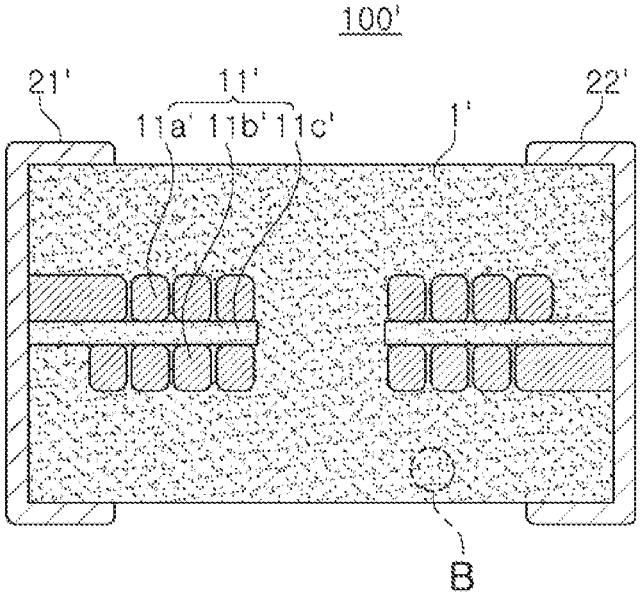
FIG. 4 is a schematic cross-sectional view of an inductor, according to another embodiment.

FIG. 4 is a perspective view of an inductor 100', according to another embodiment. FIG. 4 differs from FIG. 1 only in that a body of the inductor 100' includes a buffer powder particle instead of an organic filler, and includes substantially the same components as FIG. 1. Thus, repeated descriptions of the elements included in both FIGS. 1 and 4 will be omitted herein.

Hereinafter, the reference numerals of the corresponding components, as illustrated in FIGS. 1 and 4, will be indicated by using a superscript (').

Referring to FIG. 4, the inductor 100' may include a body 1', in which a coil 11' may be embedded, and a first external electrode 21' and a second external electrode 22' disposed on at least one of outer surfaces of the body 1'.

Figure 5:
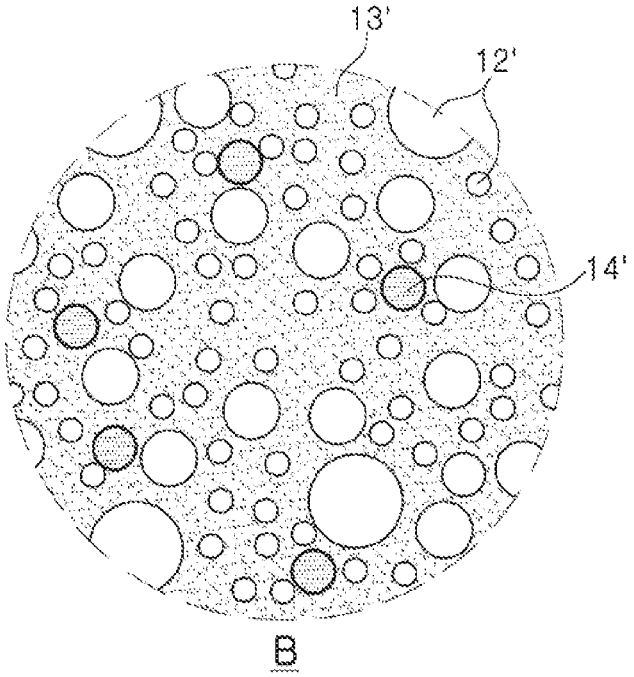
FIG. 5 is an enlarged view of region B, illustrated in FIG. 4.
Figure 6:
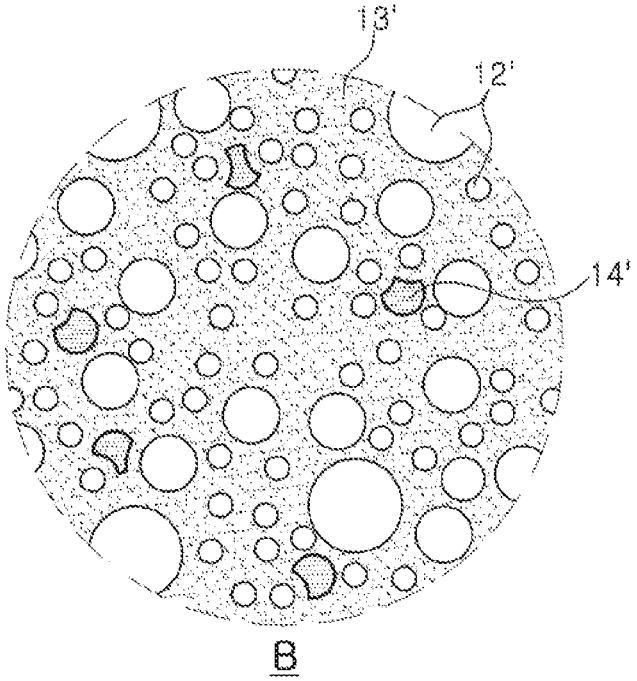
FIG. 6 is a schematic view of a deformed shape of a buffer powder particle after thermal impact is undertaken to region B, illustrated in FIG. 5.

FIG. 5 is an enlarged view of the region B illustrated in FIG. 4. FIG. 6 is a schematic view of a deformed shape of a buffer powder particle, after a thermal impact acts on the region B illustrated in FIG. 5.

According to the results of research conducted by the present inventor, a buffer powder particle 14' of FIG. 5 may preferably satisfy the following physical properties.

First, a glass transition temperature (Tg) of the buffer powder particle 14' may have a temperature range of 100° C. or higher and 200° C. or lower, and a value of a coefficient of thermal expansion ($CTE_{Tg.Low}$) of the buffer powder particle 14' within a range of a temperature below the glass transition temperature (Tg) may preferably be less than a value of a coefficient of thermal expansion ($CTE_{Tg.High}$) of the buffer powder particle 14' within a range of a temperature above the glass transition temperature (Tg). In addition, the value of the coefficient of thermal expansion ($CTE_{Tg.Low}$) of the buffer powder particle 14' within the range of the temperature below the glass transition temperature (Tg) may be preferably 150 ppm/K or less.

When the glass transition temperature (Tg) of the buffer powder particle 14' exceeds the temperature range, the buffer powder particle 14' may not be applied to stably disperse or remove stress, in a change of a temperature of a package environment in which the inductor 100' is used, may change physical properties, and may not sufficiently serve as a stress buffer.

Furthermore, when the value of the coefficient of thermal expansion ($CTE_{Tg.Low}$) of the buffer powder particle 14' within the range of the temperature below the glass transition temperature (Tg) is greater than the value of the coefficient of thermal expansion ($CTE_{Tg,High}$) of the buffer powder particle 14' within the range of the temperature above the glass transition temperature (Tg), or is greater than 150 ppm/K, the buffer powder particle 14' may become excessively sensitive in a temperature rise environment, to thus be highly likely to be deformed, which may be undesirable.

Also, the buffer powder particle 14' may preferably have a hardness value of 10 MPa or higher and 1,500 MPa or lower. The hardness value may be an indicator, regarding a degree of a mechanical impact strength of the buffer powder particle 14'.

The hardness value may be obtained through a microindenter method of measuring a displacement, for example, a depth, according to a load acting on the buffer powder particle 14'. When a hardness of the buffer powder particle 14' is lower than 10 MPa, a displacement of the buffer powder particle 14' may be excessively changed in advance, before stress generated by a magnetic powder particle or an epoxy resin is properly dispersed. When a hardness of the buffer powder particle 14' is higher than 1,500 MPa, the buffer powder particle 14' may become insensitive to an occurrence of a displacement, to the extent that the buffer powder particle 14' may not exhibit a buffer function.

When stress caused by a thermal impact is generated, an exterior of the buffer powder particle 14' may be changed, while the buffer powder particle 14' absorbs and reduces or removes the stress, as can be seen from the comparison between FIGS. 5 and 6. The meaning of 'may be changed,' above, may be that at least a portion of an initial exterior of the buffer powder particle 14' used to manufacture the body 1' is deformed to correspond to a portion of an exterior of the magnetic powder particle adjacent to the buffer powder particle 14'.

Figure 7A:
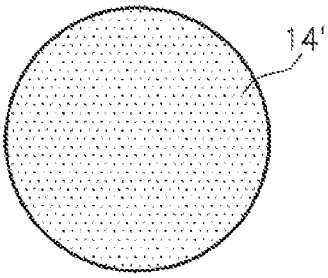
FIGS. 7A, 7B, and 7C are schematic cross-sectional views of exteriors of a buffer powder particle.
Figure 7B:
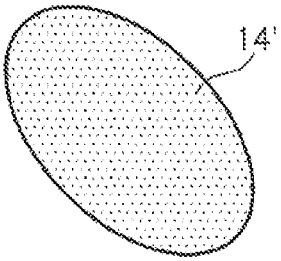
Figure 7C:
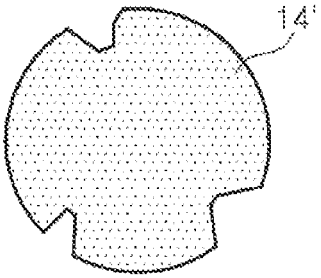

The initial exterior of the buffer powder particle 14' may be a spherical shape, as illustrated in FIG. 7A, may be an elliptical shape, as illustrated in FIG. 7B, or may include a cross section, including corners in a portion thereof (i.e., a curved shape having recesses formed thereon), as illustrated in FIG. 7C. The exterior of the buffer powder particle 14' is not particularly limited.

As set forth above, according to an embodiment, an inductor, which may disperse and remove stress that may occur due to a thermal impact acting on an interior of the inductor and to a mismatch between coefficients of thermal expansion (CTE), may be provided.

While exemplary embodiments have been shown and described above, it will be apparent to those skilled in the art that modifications and variations could be made without departing from the scope of the present invention, as defined by the appended claims.

What is claimed is:

1. An inductor comprising:

a body;

a coil embedded in the body and having an end exposed from an outer surface of the body; and an external electrode disposed on the outer surface of the body and connected to the end of the coil, wherein the body includes magnetic powder particles, a base resin, and an organic filler, and the organic filler and the magnetic powder particles are dispersed in the base resin, and the organic filler and the magnetic powder particles are disposed on an upper side of the coil and a lower side of the coil opposing the upper side.

2. The inductor of claim 1, wherein the organic filler has a grain boundary, different from a grain boundary of the magnetic powder particles, and the organic filler is randomly dispersed in the base resin, along with the magnetic powder particles.

3. The inductor of claim 1, wherein the organic filler is a thermoplastic resin.

4. The inductor of claim 3, wherein the organic filler includes acrylonitrile-butadiene-styrene (ABS), cellulose acetate, nylon, polymethyl methacrylate (PMMA), polybenzimidazole, polycarbonate, polyether sulfone, polyetherether ketone (PEEK), polyetherimide (PEI), polyethylene, polylactic acid, polyoxymethylene, polyphenylene oxide, polyphenylene sulfide, polypropylene, polystyrene, polyvinyl chlroride, ethylene vinyl acetate, polyvinyl alcohol, or polyethylene oxide.

5. The inductor of claim 4, wherein the organic filler is polymethyl methacryate beads.

6. The inductor of claim 1, wherein the body further includes another organic filler dispersed in the base resin, and a composition of the organic filler is different from a composition of the another organic filler adjacent to the organic filler.

7. The inductor of claim 1, wherein the base resin is an epoxy resin or a polyimide resin.

8. The inductor of claim 1, wherein, based on 100 wt % of the magnetic powder particles, a content of the base resin is from 1 wt % to 50 wt %, and a content of the organic filler is from 0.01 wt % to 50 wt %.

9. An inductor comprising:

a body including a coil; and an external electrode disposed on an outer surface of the body, wherein the body further includes magnetic powder particles and non-magnetic particles dispersed among a base resin thereof, the non-magnetic particles comprising organic particles, and for a same volume, a degree of deformation of the non-magnetic particles is greater than a degree of deformation of the magnetic powder particles and a degree of deformation of the base resin, in response to an external force or a change in temperature.

10. The inductor of claim 9, wherein the non-magnetic particles have a glass transition temperature (Tg) value of 100° C. or above and 200° C. or below, a value of a coefficient of thermal expansion ($CTE_{Tg.Low}$) of the non-magnetic particles within a range of a temperature below the glass transition temperature (Tg) is less than a value of a coefficient of thermal expansion ($CTE_{Tg.High}$) of the non-magnetic particles within a range of a temperature higher than the glass transition temperature (Tg), and the value of the coefficient of thermal expansion ($CTE_{Tg.Low}$) of the non-magnetic particles within the range of the temperature below the glass transition temperature (Tg) is 150 ppm/K or less.

11. The inductor of claim 9, wherein a hardness value of the non-magnetic particles is from 10 MPa to 1,500 MPa.

12. The inductor of claim 9, wherein the base resin is an epoxy resin or a polyimide resin and the non-magnetic particles are polymethyl methacryate beads.

13. The inductor of claim 9, wherein, for the same volume, the degree of deformation of the non-magnetic particles is greater than a degree of deformation of any other materials contained in the body, in response to the external force or the change in temperature.

14. An inductor comprising:

a body;

a coil embedded in the body, the coil including a first coil and a second coil disposed on opposing surfaces of a support member, respectively; and first and second external electrode disposed outside the body and connected to the first and second coils, respectively, wherein the body includes a base resin, and magnetic powder particles and an organic filler randomly dispersed in the base resin.

15. The inductor of claim 14, wherein the organic filler has a grain boundary, different from a grain boundary of the magnetic powder particles.

16. The inductor of claim 14, wherein the organic filler includes a thermoplastic resin.

17. The inductor of claim 16, wherein the organic filler includes acrylonitrile-butadiene-styrene (ABS), cellulose acetate, nylon, polymethyl methacrylate (PMMA), polybenzimidazole, polycarbonate, polyether sulfone, polyetherether ketone (PEEK), polyetherimide (PEI), polyethylene, polylactic acid, polyoxymethylene, polyphenylene oxide, polyphenylene sulfide, polypropylene, polystyrene, polyvinyl chlroride, ethylene vinyl acetate, polyvinyl alcohol, or polyethylene oxide.

18. The inductor of claim 17, wherein the organic filler includes polymethyl methacryate beads.

19. The inductor of claim 14, wherein the body further includes another organic filler dispersed in the base resin, and a composition of the organic filler is different from a composition of the another organic filler adjacent to the organic filler.

20. The inductor of claim 14, wherein the base resin includes an epoxy resin or a polyimide resin.

21. The inductor of claim 14, wherein, based on 100 wt % of the magnetic powder particles, a content of the base resin is from 1 wt % to 50 wt %, and a content of the organic filler is from 0.01 wt % to 50 wt %.

* * * * *